US007299750B2

(12) United States Patent
Schikora et al.

(10) Patent No.: US 7,299,750 B2
(45) Date of Patent: Nov. 27, 2007

(54) PARTIAL FRAGMENTATION AND DEFORMATION BULLETS HAVING AN IDENTICAL POINT OF IMPACT

(75) Inventors: Irene Schikora, Furth (DE); Friedrich Riess, Furth (DE); Bernd Krause, Nuremberg (DE)

(73) Assignee: Ruag Ammotec GmbH, Furth (DE)

( * ) Notice: Subject to any disclaimer, the term of this patent is extended or adjusted under 35 U.S.C. 154(b) by 0 days.

(21) Appl. No.: 10/512,968

(22) PCT Filed: Apr. 30, 2003

(86) PCT No.: PCT/EP03/04503

§ 371 (c)(1),
(2), (4) Date: Jul. 1, 2005

(87) PCT Pub. No.: WO03/093758

PCT Pub. Date: Nov. 13, 2003

(65) Prior Publication Data

US 2005/0241523 A1 Nov. 3, 2005

(30) Foreign Application Priority Data

Apr. 30, 2002 (DE) ..... 102 19 480
Apr. 15, 2003 (DE) ..... 103 17 404

(51) Int. Cl.
*F42B 10/00* (2006.01)

(52) U.S. Cl. ..... 102/506; 102/507; 102/508; 102/509; 102/510; 86/54

(58) Field of Classification Search ..... 86/54; 102/506–510; 206/3, 443, 593
See application file for complete search history.

(56) References Cited

U.S. PATENT DOCUMENTS 4,175,492 A * 11/1979 Knappworst et al. ..... 102/503
4,665,827 A * 5/1987 Ellis, II ..... 102/510
4,777,883 A * 10/1988 Chevich ..... 102/503
4,945,836 A * 8/1990 Michaels ..... 102/503
6,655,295 B2 * 12/2003 Baumgartner et al. ..... 102/510

* cited by examiner

*Primary Examiner*—Michael J. Carone
*Assistant Examiner*—Stewart T Knox
(74) *Attorney, Agent, or Firm*—Antonelli, Terry, Stout & Kraus, LLP.

(57) ABSTRACT

Especially in hunting, the choice of bullets has to be such that it is in keeping with the wild animals to be hunted. According to the desired effect on the target, deformation bullets or partial fragmentation bullets are used. Since both types of bullets are different, the position of the point of impact from the same weapon is different. According to the type of bullet used, the weapon must be oriented differently in relation to the target. This can be obstructive and if insufficient attention is paid, can result in misses. According to the invention, a shell-less cored steel bullet is used as a deformation bullet (1) or partial fragmentation bullet (2), having an identical caliber and a closed cavity (4) in the tip (3) of said bullet In order to achieve the same point of impact of said bullets (1,2) on the target, while maintaining the effect of the respectively selected bullet during the same handling of the weapon, during the same setting of the target in an identical position, the external volume, centre of gravity, mass and base copper-tin alloy are identical and the cavity (E) in the tip (3) of the bullet, consisting of a combination of cylindrical and conical sections (10, 12, 13; 20), in addition to the composition of the bullet material, are adapted to the effect of said bullet.

12 Claims, 3 Drawing Sheets

PARTIAL FRAGMENTATION AND DEFORMATION BULLETS HAVING AN IDENTICAL POINT OF IMPACT

The invention relates to partial fragmentation bullets and deformation bullets having an identical position of the point of impact.

In particular in hunting the choice of bullets has to be matched to the game to be hunted. Depending on the desired effect at the target deformation bullets or partial fragmentation bullets are used. Since these are different types of bullets, the position of the point of impact when firing from the same weapon is different. The weapon has to be aligned differently with the target, depending on the type of bullet used, something which can be obstructive, but if neglected results in misses. A partial fragmentation bullet is known, for example, from DE 199 30 475 A1; a deformation bullet for small arms is known from DE 100 10 500 A1.

The object of the invention is to present partial fragmentation bullets and deformation bullets which, despite having different effects, given the same handling of the weapon, given the same alignment with the target, have the same position of the point of impact at the target point.

The object is achieved with two types of bullets as shell-less solid bullets that have a closed cavity in the tip of the bullet, with the cavity consisting of a combination of cylindrical and conical sections that are matched to the effect of either a deformation bullet or a partial fragmentation bullet, and with the necessary forces that result in the different effects of the bullets at the target with an identical position of the point of impact being defined as a result of the combined action of the structural configuration of the cavity and the material properties. All the other features of the two types of bullets are otherwise identical: the external volume, the position of the centre of gravity, the mass, the calibre, and the base alloy, a copper-zinc alloy.

The materials of the bodies of the bullets are composed of 55% to 99% copper and 1% to 45% zinc. The ductility of the material can be influenced by the proportion of zinc. The ductility decreases with a rising proportion of zinc. The proportion of copper in the alloy is therefore higher in the case of deformation bullets than in the case of partial fragmentation bullets.

In the case of the partial fragmentation bullets in addition another portion of up to 4% of elements that positively influence the splinter-formation and thus the fragmentation, preferably lead or tellurium and phosphorus, can be added, to the debit of the basic composition.

If in the case of the two types of bullets given the features that are provided that are otherwise identical the same masses are to result, the alloy of the partial fragmentation bullet and the alloy of the deformation bullet must be matched to each other.

Furthermore, the shaping of the cavity substantially contributes to the fragmentation-performance characteristics of the respective body of the bullet given the combination of conical and cylindrical sections, the shaft bore also counting towards this, as does the choice of the opening angles of the conical sections. In the case of the partial fragmentation bullet, a conical section whose cone angle is different from that of the preceding conical portion can additionally be provided in front of the shaft bore.

The bullet constructions in accordance with the invention have the same position of the point of impact and despite having a different effect at the target point enable the handling of the weapon to be the same, that is, enable the aim at the target point to be the same.

The invention is explained in greater detail with the aid of two preferred exemplary embodiments for 0.30 calibres. In the drawings.

Figure 1:
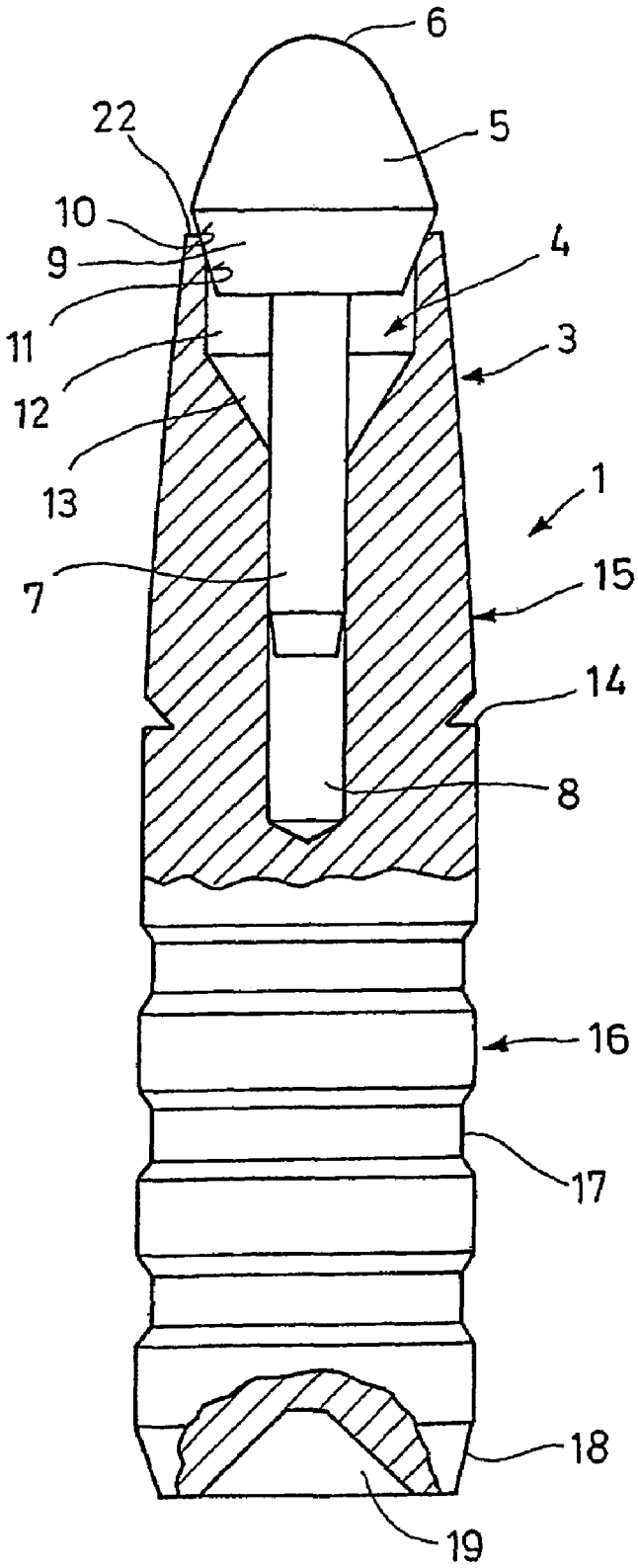
FIG. 1 shows a deformation bullet in accordance with the invention.

The two bullet types are similar at first sight to the bullet known from DE 199 30 475 A1. First of all, the corresponding features of the two types of bullets, the deformation bullet 1 according to FIG. 1 and the partial fragmentation bullet 2 according to FIG. 3, will be described, with the same reference numerals being used to denote them. Both types of bullets 1 and 2 have in the tip 3 of the bullet a cavity 4 which is closed by a cap 5 made from plastics material or from a lead-free material. The cap 5 has a double-cone form with a rounded-off tip 6, which projects out of the bullet 1, 2, and on the opposite side has a shaft 7 which extends into a bore 8 in the bullet 1, 2 following on from the cavity 4. The latter has, in the case of the present exemplary embodiments, in the case of the deformation bullet 1 a length of approximately 5 mm and in the case of the partial fragmentation bullet a length of approximately 6.4 mm. The bore 8 has approximately twice the length of the shaft 7 that extends into the bore, the shaft 7 here being approximately 8.5 mm long, and has a diameter of approximately 2 mm. The cone 9 on the shaft side of the cap 5 and thus the opening 10 of the cavity 4 have, in the present exemplary embodiment, an angle of approximately 40 degrees. Depending on the calibre, this angle can vary between approximately 30 and 50 degrees. The supporting surface 11 on the edge of the bullet, the opening 10, has a length of approximately 1 mm that can vary, depending on the calibre, by a few tenths of a millimetre. Following on from the conical opening 10 there is a cylindrical section 12 of the cavity 4 which is approximately 2 mm long and can also vary, depending on the calibre, by a few tenths of a millimetre. Its diameter amounts here to approximately 4.75 mm and can also vary, depending on the calibre, by a few tenths of a millimetre. Following on from this there is a conical section 13 of the cavity 4 which is approximately 2 mm long. Its length can also vary by a few tenths of a millimetre. In the present exemplary embodiment, the cone angle amounts to 70 degrees. It too can vary, depending on the calibre, from approximately 60 to 80 degrees. A sharp edge 14 substantially marks the transition of the conical portion 15 of the bullet 1, 2 to the cylindrical portion 16. The bullet 1, 2 has relief grooves 17 on the cylindrical portion 16 and in the tail 18 it can have a tail cone 19.

The outer volume is identical in the case of both the deformation bullet 1 and the partial fragmentation bullet 2.

Figure 3:
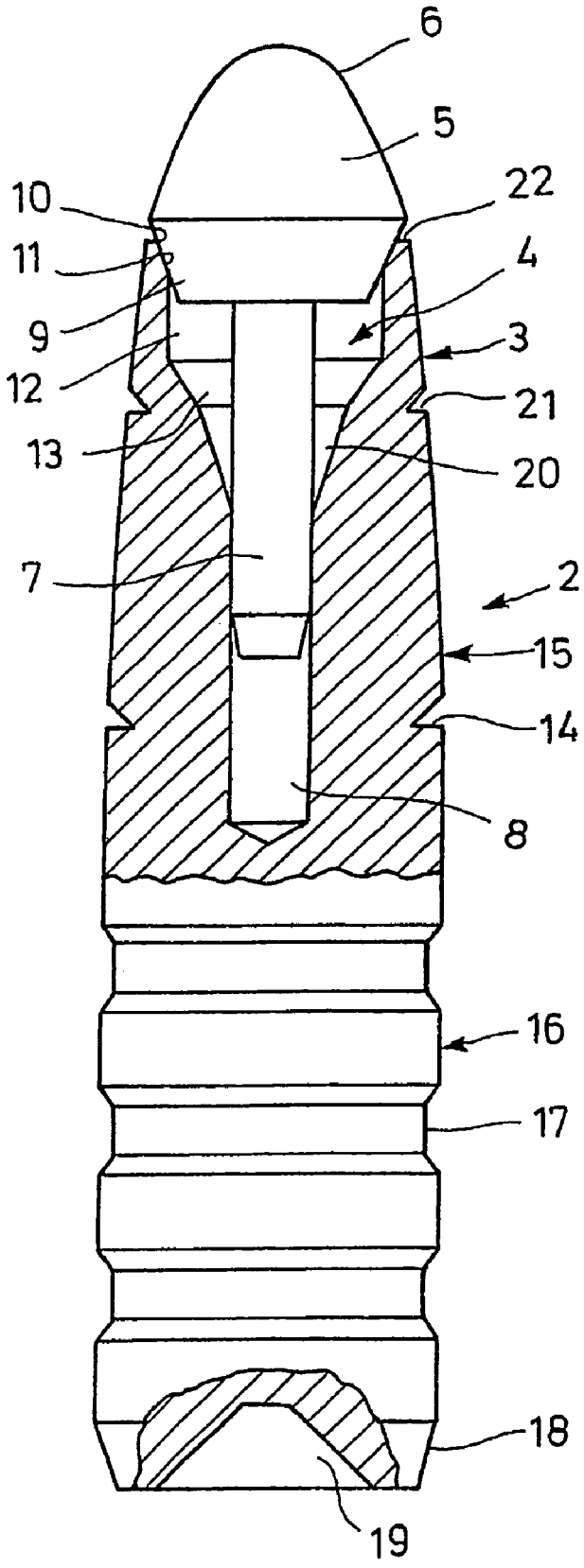
FIG. 3 shows a partial fragmentation bullet in accordance with the invention.

The partial fragmentation bullet 2 according to FIG. 3 differs in the development of the cavity 4 as a result of a further conical section 20, in front of the shaft bore 8, and a circumferential notch 21 as a predetermined breaking point at the level of the beginning of this conical section 20. The cone angle amounts to 30 degrees and can vary, depending on the calibre, from approximately 20 to 40 degrees. The length of this conical section 20 of the cavity 4 amounts to approximately 2 mm to 3 mm, depending on the calibre, preferably to approximately 2.5 mm.

In the present exemplary embodiment the material composition in the case of the deformation bullet 1 is 70% Cu and 30% Zn and in the case of the partial fragmentation bullet 2 is 62% Cu and 38% Zn. In order to arrive at the same mass in the case of the two types of bullets, the material composition of the partial fragmentation bullet 2 can be matched thereto.

The principle of the effect of the bullets 1 and 2 can be described as follows. When a bullet strikes the target, the cap 5 dips by way of its rear conical surface 9 into the cavity 4 and thus initiates the deformation. As a result, the edge 22 of the opening 10 of the cavity 4 is exposed and forms a cutting ring. This cutting ring, when it strikes a tissue, carries out a punching effect and penetrates into the tissue. The oncoming tissue, on account of the hydrodynamic pressure, effects the deformation until the final form results.

Figure 2:
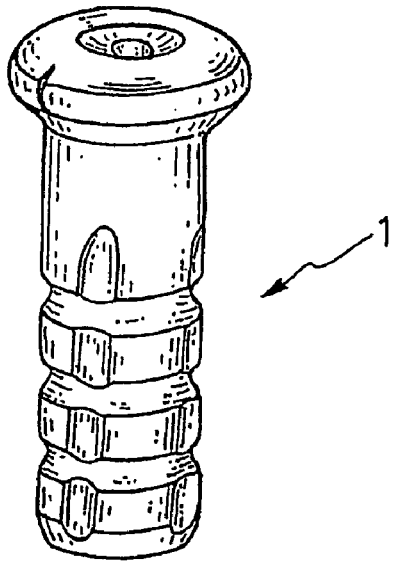
FIG. 2 shows the performance characteristics of the deformation bullet after firing at a soft target.

The end of the deformation is reached when the structural forces of the bullet material are greater than the hydrodynamic forces of the oncoming tissue. Such an effect on the bullet can be seen in FIG. 2 in which a deformation bullet 1 is shown after striking a soft body. The tip of the bullet is compressed, but has not fragmented.

Figure 4:
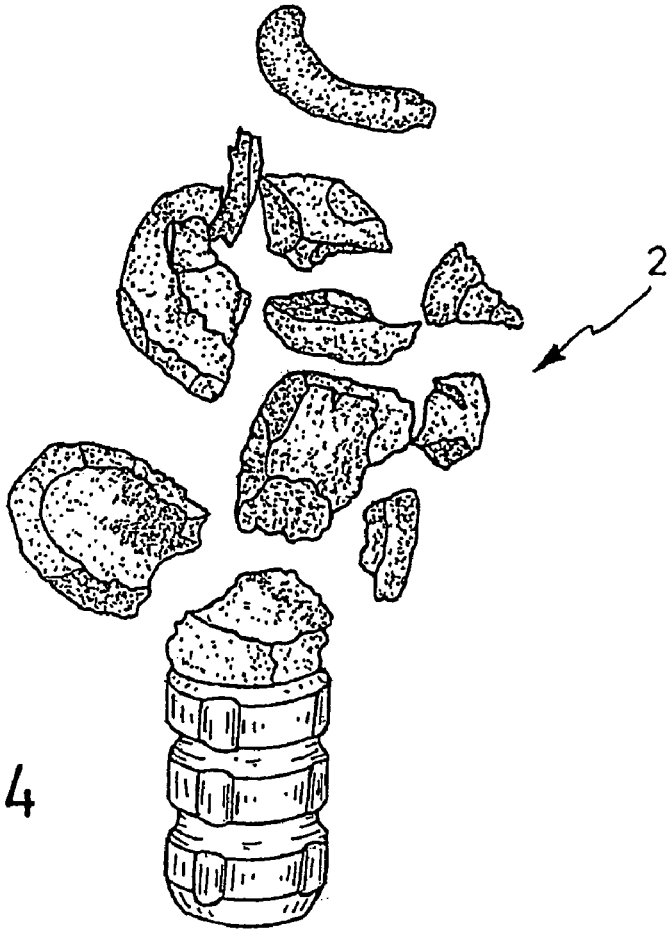
FIG. 4 shows the performance characteristics of the partial fragmentation bullet after firing at a soft target.

By adapting the geometry and the material properties, the inner force of the bullet can be decreased to such an extent that the hydrodynamic pressure tears the bullet material, and the result of this is the effect of a partial fragmentation bullet 2. A partial fragmentation bullet is shown in FIG. 4 after it has struck a soft body. Upon mushrooming out, the conical region of the bullet fragmented into individual splinters.

The deformation is thus dependent upon the approach speed of the tissue, in accordance with the bullet speed, and the forces that act on the material as a result. The effect of the forces is influenced by the described different development of the cavities in the bullets and the respective material properties.

The invention claimed is:

1. A method for fabricating jacketless cored bullets, including both a partly fragmenting bullet and a deformable bullet, comprising:

fabricating a deformable bullet having a bullet tip and a bullet tail, and having an enclosed cavity within the bullet tip, the enclosed cavity being closed by a cap, the deformable bullet comprising a base alloy of copper and zinc; and fabricating a partly fragmenting bullet having a bullet tip and a bullet tail, and having an enclosed cavity within the bullet tip, the enclosed cavity being closed by a cap, the partly fragmenting bullet comprising a base alloy of copper and zinc;

wherein the partly fragmenting bullet is fabricated with an impact point position, a caliber, an external volume, a mass, and a center of gravity substantially identical to that with which the defomiable bullet is fabricated, but wherein the enclosed cavity of the partly fragmenting bullet is enlarged relative to the deformable bullet by an additional portion and wherein a mass loss caused by enlargement of the enclosed cavity of the partly fragmenting bullet is compensated by changing relative proportions of copper and zinc in the base alloy and/or by adding at least one element positively influencing fragmentation at the cost of the copper and zinc of the base alloy.

2. The method for fabricating jacketless cored bullets according to claim 1, wherein the deformable bullet is fabricated with a higher copper content than the partly fragmenting bullet to increase a ductility of the deformable bullet.

3. The method for fabricating jacketless cored bullets according to claim 2, wherein, in fabricating the partly fragmenting bullet, lead is added to the base alloy.

4. The method for fabricating jacketless cored bullets according to claim 2, wherein, in fabricating the partly fragmenting bullet, at least one of tellurium and phosphorus is added to the base alloy.

5. The method for fabricating jacketless cored bullets according to claim 1, wherein, in fabricating the partly fragmenting bullet, lead is added to the base alloy.

6. The method for fabricating jacketless cored bullets according to claim 1, wherein, in fabricating the partly fragmenting bullet, at least one of tellurium and phosphorus is added to the base alloy.

7. A set of jacketless cored bullets, including both a partly fragmenting bullet and a deformable bullet, comprising:

a deformable bullet having a bullet tip and a bullet tail, and having an enclosed cavity within the bullet tip, the enclosed cavity being closed by a cap, the deformable bullet comprising a base alloy of copper and zinc; and a partly fragmenting bullet having a bullet tip and a bullet tail, and having an enclosed cavity within the bullet tip, the enclosed cavity being closed by a cap, the partly fragmenting bullet comprising a base alloy of copper and zinc;

wherein the partly fragmenting bullet has an impact point position, a caliber, an external volume, a mass, and a center of gravity substantially identical to that of the deformable bullet, but wherein the enclosed cavity of the partly fragmenting bullet is larger relative to the enclosed cavity of the deformable bullet by an additional portion and wherein a mass loss caused by the larger enclosed cavity of the partly fragmenting bullet is compensated by a change in relative proportions of copper and zinc In the base alloy and/or by an addition of at least one element positively influencing fragmentation at the cost of the copper and zinc of the base alloy.

8. The set of jacketless cored bullets according to claim 7, wherein the deformable bullet has a higher copper content than the partly fragmenting bullet to increase a ductility of the deformable bullet.

9. The set of jacketless cored bullets according to claim 8, wherein the partly fragmenting bullet comprises the base alloy and lead.

10. The set of jacketless cored bullets according to claim 8, wherein the partly fragmenting bullet comprises the base alloy, lead and at least one of tellurium and phosphorus.

11. The set of jacketless cored bullets according to claim 7, wherein the partly fragmenting bullet comprises the base alloy and lead.

12. The set of jacketless cored bullets according to claim 7, wherein the partly fragmenting bullet comprises the base alloy, lead and at least one of tellurium and phosphorus.

* * * * *